US006483496B2

(12) United States Patent
Kobayashi et al.

(10) Patent No.: US 6,483,496 B2
(45) **Date of Patent: *Nov. 19, 2002**

(54) DRIVE CIRCUIT FOR DISPLAY APPARATUS

(75) Inventors: Mitsugu Kobayashi, Nagoya (JP); Makoto Kitagawa, Gifu (JP)

(73) Assignee: Sanyo Electric Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/348,709

(22) Filed: Jul. 7, 1999

(65) Prior Publication Data

US 2002/0145583 A1 Oct. 10, 2002

(30) Foreign Application Priority Data

Jul. 9, 1998 (JP) ..... 10-194826
Jul. 9, 1998 (JP) ..... 10-194827

(51) Int. Cl.[7] ..... G09G 3/36

(52) U.S. Cl. ..... 345/98; 345/98; 345/690; 345/208

(58) Field of Search ..... 345/87–101, 204–215, 345/690, 691, 692, 693; 348/761

(56) References Cited

U.S. PATENT DOCUMENTS 5,214,418 A * 5/1993 Fukumura et al. ..... 345/88
5,883,608 A * 3/1999 Hashimoto ..... 345/96
6,121,950 A * 9/2000 Zavracky et al. ..... 345/101
6,188,395 B1 * 2/2001 Yatabe ..... 345/211

FOREIGN PATENT DOCUMENTS

EP 50145 A2 * 9/1992
JP 403181986 A * 8/1991

* cited by examiner

*Primary Examiner*—Steven Saras
*Assistant Examiner*—Amr Awad
(74) *Attorney, Agent, or Firm*—Hogan & Hartson, LLP

(57) ABSTRACT

A reference voltage control circuit is provided and includes a reference voltage data generator circuit for generating reference voltage data PD from brightness data BD, and a selector for selecting, in accordance with a timing control signal Tc, a reference voltage data CD and digital R, G, and B data. By varying the reference voltage level in accordance with the brightness level, the DC component of the voltage signal obtained by clamping the reference voltage level is controlled. Furthermore, when controlling the brightness for every R, G, and B color, the reference voltage data CD (CDR, CDG, CDB) for the R, G, and B colors are generated by adding the brightness data BD and the sub-brightness data SB (SBR, SBG, SBB) for every R, G, and B color.

14 Claims, 5 Drawing Sheets

DRIVE CIRCUIT FOR DISPLAY APPARATUS

BACKGROUND OF THE INVENTION

1. Field of the Invention

The present invention relates to a drive circuit for a liquid crystal display apparatus (LCD), and more particularly to a drive circuit having a simple circuit configuration for performing brightness adjustment and sub-brightness adjustment.

2. Description of the Prior Art

An LCD has a configuration in which liquid crystals are filled between electrode substrates, where transparent electrodes are formed on transparent substrates. Liquid crystals are electro-optically anisotropic so that by applying a desired voltage across the electrodes to generate an electric field on the liquid crystals, the liquid crystals exhibit optical characteristics in accordance with the electric field strength. By utilizing this property and applying a different voltage on every pixel, a display picture is generated as a collection of pixels with each pixel having a desired brightness. Thus, with pictures generated from voltage control, the LCD has advantages in terms of compact size, thin form, low power consumption, and so forth, and has increased practical applications in the fields of computer equipment and audio-visual equipment.

FIG. 1 shows a configuration of this sort of LCD module comprising a signal processor circuit 1 for performing brightness control, contrast control, gamma correction, and so forth, for input RGB digital data VD, a D/A converter 2 for converting the digital data VD that is output from the signal processor circuit 1 into analog signals, an RGB driver 3 for switching an inverting/non-inverting amplification of the RGB analog image signals that are output from the D/A converter 2, and an LCD 4.

FIG. 2 shows a brightness control circuit within the signal processor circuit 1. The RGB digital data VD and brightness data BD are supplied to an adder circuit 15 and added. Here, the brightness data BD is, for example, 8-bit data generated in accordance with an external adjustment knob, a key input, or the like. The digital data VD is, for example, 8 bits, and the brightness data BD is added, for example, to a position from the third bit of the digital data VD so that a corrected 10-bit digital data is output. The same brightness control circuit is provided for each of the R, G, and B colors.

Since the tint changes if there are variations among the individual RGB lines, the RGB driver 3 is provided with a sub-brightness adjustment terminal (not shown) formed from a variable resistance to allow adjustments for every IC.

Thus, when performing detailed brightness control, the correction data to be output from the brightness control circuit has a higher number of bits than the input data. Therefore, the size of the circuit of the D/A converter 2 increases and its cost increases. On the other hand, if the number of bits is decreased in order to avoid an increase in cost, the picture quality deteriorates.

Although the sub-brightness adjustment terminal is formed from an external variable resistance or the like, miniaturization of the package was hindered and the manufacturing cost increased.

Furthermore, although it is also possible to use a D/A converter with a built-in variable resistance and to have it controlled by a microcomputer, a D/A converter becomes necessary for each of the R, G, and B colors so that an increase in circuit size still cannot be avoided.

SUMMARY OF THE INVENTION

It is therefore an object of the present invention to solve the aforementioned problems and to provide a drive circuit capable of brightness control without any increase in circuit size.

In order to achieve this object, the present invention has the following features.

First, in one aspect of the present invention, a drive circuit for display apparatus, which comprises a plurality of display elements, comprises: a reference voltage control circuit for controlling a reference voltage level on the basis of brightness control signal in a blanking period of an input image signal; a clamping circuit for clamping the reference voltage level of a signal output from the reference voltage control circuit; and an amplifier circuit for amplifying a signal output from the clamping circuit.

In this manner, by controlling the reference voltage level in accordance with the brightness level and by clamping the reference voltage level, the DC voltage component of the image signal can be controlled, thereby making it possible to perform brightness control without an increase in circuit size.

In another aspect of the present invention, the drive circuit for display apparatus, which comprises a plurality of display elements, comprises: the reference voltage control circuit for outputting, instead of the input image signal during the blanking period of the input image signal, the reference voltage data generated on the basis of the brightness control signal, and outputting, during an effective display period of the input image signal, the input image signal; the clamping circuit for converting the reference voltage level in the blanking period of the signal output from the reference voltage control circuit into a predetermined brightness reference level; and the amplifier circuit for amplifying the signal output from the clamping circuit.

In this aspect, the brightness reference level can be adjusted by switching the signal to be output to the clamping circuit with the blanking period and the effective display period of the input image signal between the input image signal and the reference voltage data.

In the above-mentioned aspect, the reference voltage control circuit may have a configuration comprising: a reference voltage data generator circuit for generating the reference voltage data corresponding to the reference voltage level on the basis of the brightness control signal; and a switching circuit for switching, in accordance with the timing signal, the input image signal and the reference voltage data to be output.

This sort of simple circuit configuration enables the output to be switched so that the control of the DC voltage component of the input image signal can be easily executed without an increase in circuit size.

Also for the case of digital signal processing, if the digital reference voltage data generated on the basis of the digital brightness control signal is output instead of the digital input image signal, the brightness reference level can be adjusted without an increase in the number of data bits.

In another aspect of the present invention, the drive circuit for display apparatus, which comprises a plurality of display elements, comprises: the reference voltage control circuit for controlling the reference voltage level on the basis of the brightness control signal and sub-brightness control signal in the blanking period of the input image signal; the clamping circuit for clamping the reference voltage level of the signal output from the reference voltage control circuit; and the amplifier circuit for amplifying the signal output from the clamping circuit.

In this manner, controlling the reference voltage level in accordance with the brightness level and sub-brightness level and clamping the reference voltage, enables the DC voltage component of the image signal to be controlled, thereby making it possible to perform brightness control without an increase in circuit size.

In another aspect of the present invention, the drive circuit for display apparatus, which comprises a plurality of display elements, comprises: the reference voltage control circuit for outputting, instead of the input image signal during the blanking period of the input image signal, the reference voltage data generated on the basis of the brightness control signal and sub-brightness control signal, and outputting, during the effective display period of the input image signal, the input image signal; the clamping circuit for converting the voltage level in the blanking period of the signal output from the reference voltage control circuit into a predetermined brightness reference level; and the amplifier circuit for amplifying the signal output from the clamping circuit.

In this aspect, the signal to be output to the clamping circuit is switched with the blanking period and effective display period of the input image signal between the input image signal and the reference voltage data generated on the basis of the brightness and sub-brightness control signals. The brightness reference level of the image signal can be adjusted by the reference voltage data that is output as a result of this switching operation.

In the above-mentioned aspect, the reference voltage control circuit may have a configuration comprising: the reference voltage data generator circuit for generating the reference voltage data corresponding to the reference voltage level on the basis of the brightness control signal; and the switching circuit for switching, in accordance with the timing signal, the input image signal and the reference voltage data to be output.

Since the switching of the output can be realized in this manner through a simple configuration of the reference voltage control circuit, the control of the DC voltage component of the image signal can be executed without an increase in circuit size.

Also for the case of digital signal processing, if the digital reference voltage data generated on the basis of the digital brightness control signal is output instead of the digital input image signal, the brightness reference level can be adjusted without an increase in the number of data bits.

With regard to the above-mentioned drive circuit in another aspect of the present invention, the above-mentioned sub-brightness control signal is individually set for each of the red image signal, green image signal, and blue image signal for color display.

In the display apparatus, such as a liquid crystal display apparatus, the transmittance differs for each of the R light, G light, and B light. In this case also, the brightness of the image signal for every color can be adjusted with the sub-brightness control signal. Furthermore, the brightness adjustment for every color can be realized in a circuit configuration where the reference voltage data generated on the basis of the brightness and sub-brightness control signal is output instead of the input image signal during the blanking period. Therefore, a sub-brightness adjustment terminal, which leads to an increase in circuit area, is unnecessary, thereby preventing an obstacle to miniaturization of the package and preventing an increase in manufacturing cost.

DETAILED DESCRIPTION OF THE PREFERRED EMBODIMENTS

Figure 1:
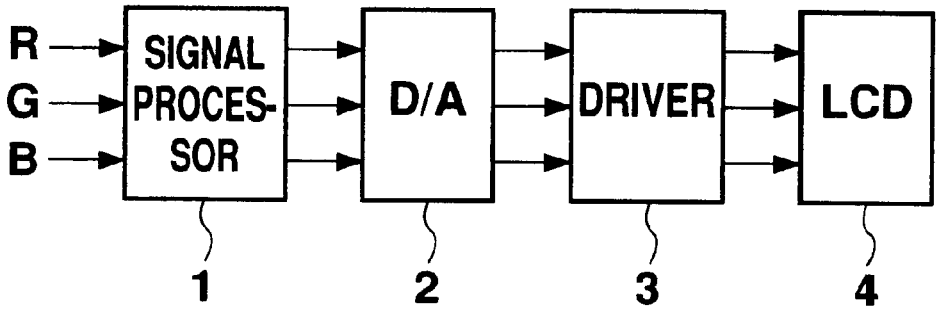
Fig. 1 PRIOR ART
FIG. 1 shows the configuration of a conventional LCD module.
Figure 2:
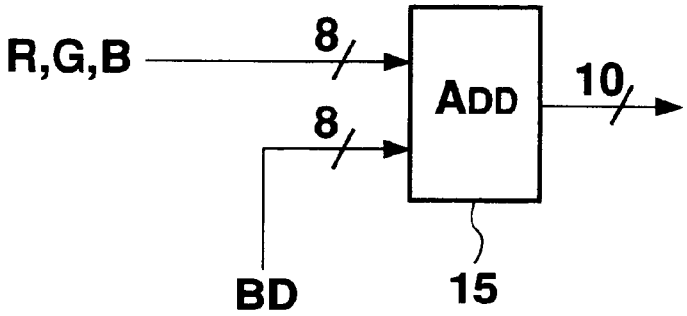
Fig. 2 PRIOR ART
FIG. 2 shows the configuration of a conventional brightness control circuit.
Figure 3:
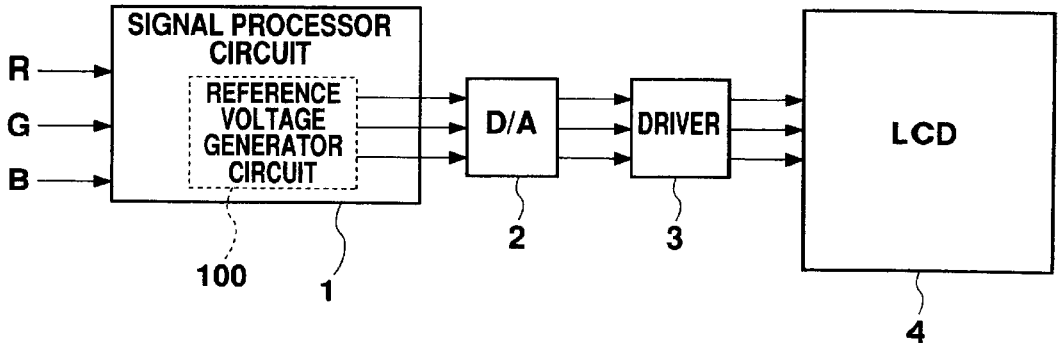
FIG. 3 shows the configuration of an LCD module relating to an embodiment of the present invention.
Figure 4:
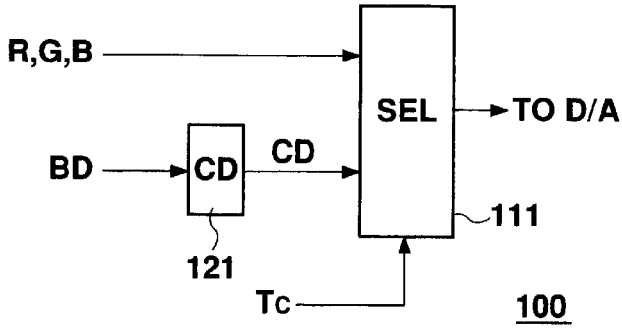
FIG. 4 shows an example configuration of a reference As voltage control circuit of the LCD module relating to the embodiment of the present invention.

FIG. 3 shows the configuration of the LCD module relating to the embodiment of the present invention and FIG. 4 shows the configuration of a reference voltage generator circuit 100 within the module of FIG. 3.

The LCD module comprises the signal processor circuit 1 for performing brightness and contrast control on the input RGB digital data and for performing gamma correction, the digital/analog (D/A) converter circuit 2 for converting the digital data VD that is output from the signal processor circuit 1 into an analog signal, and the LCD 4.

The reference voltage control circuit 100 within the signal processor circuit 1 of FIG. 3 functions as a brightness controller in this aspect. This control circuit 100 comprises a selector 111 and a reference voltage data generator circuit 121. The reference voltage data generator circuit 121 generates reference voltage data CD in accordance with the brightness data BD. The reference voltage data CD is supplied together with the digital RGB data to the selector 111. The selector 111 outputs either the digital RGB data or the reference voltage data CD in accordance with a timing control signal Tc. Described in more detail, the digital RGB data is output during the effective display period of the digital RGB data whereas the reference voltage data CD is output during the blanking period.

Figure 5:
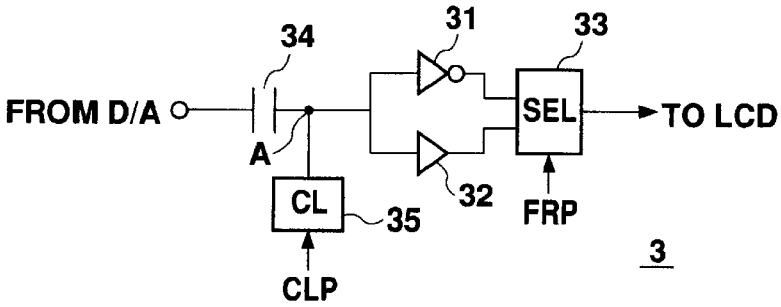
FIG. 5 shows the configuration of an RGB driver of the LCD module relating to the embodiment of the present invention.

FIG. 5 shows a detailed configuration of the RGB driver 3 relating to the embodiment of the present invention. An inverting amplifier 31, a non-inverting amplifier 32, a selector 33, a capacitor 34, and a clamping circuit 35 are provided. The analog RGB signal that is sent from the D/A converter 2 has its DC components filtered by the capacitor 34 and is supplied to the clamping circuit 35. The clamping circuit 35 clamps the reference voltage level of the analog RGB signal in accordance with a clamping pulse CLP, which is turned on only within the blanking period of the RGB signals, so that the DC component is regenerated. The RGB signal, which underwent DC regeneration, is sent to the inverting amplifier 31 for inversion and amplification, and to the non-inverting amplifier 32 for non-inverting amplification.

The inverted amplified signal and the non-inverted amplified signal are sent to the selector 33 for selection according to a polarity inversion pulse FRP and the selected signal is sent to the LCD 4 as a picture signal having an inverted polarity for every fixed period.

Figure 6:
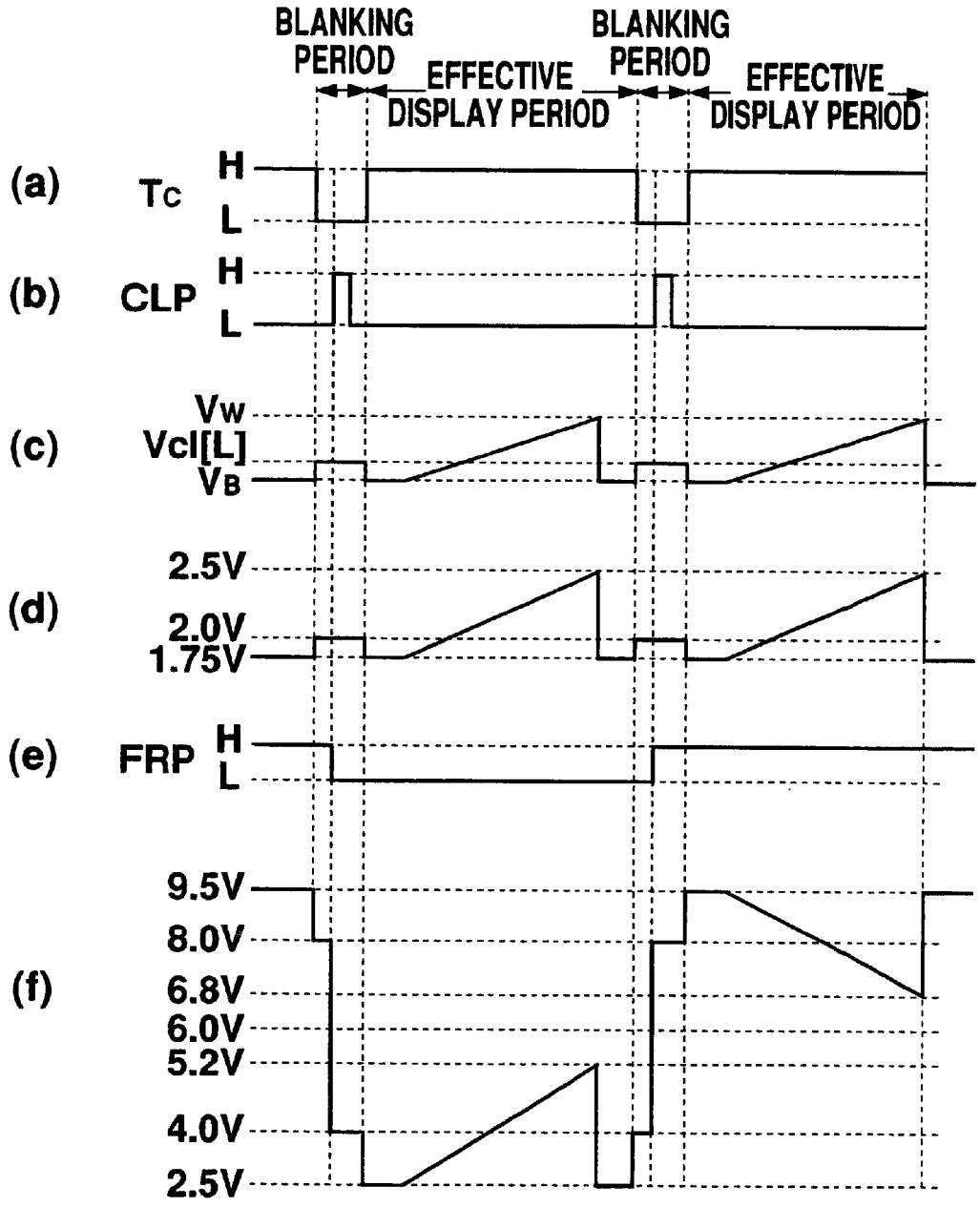
FIG. 6 and FIG. 7 show signal waveforms of the LCD module relating to the embodiment of the present invention.
Figure 7:
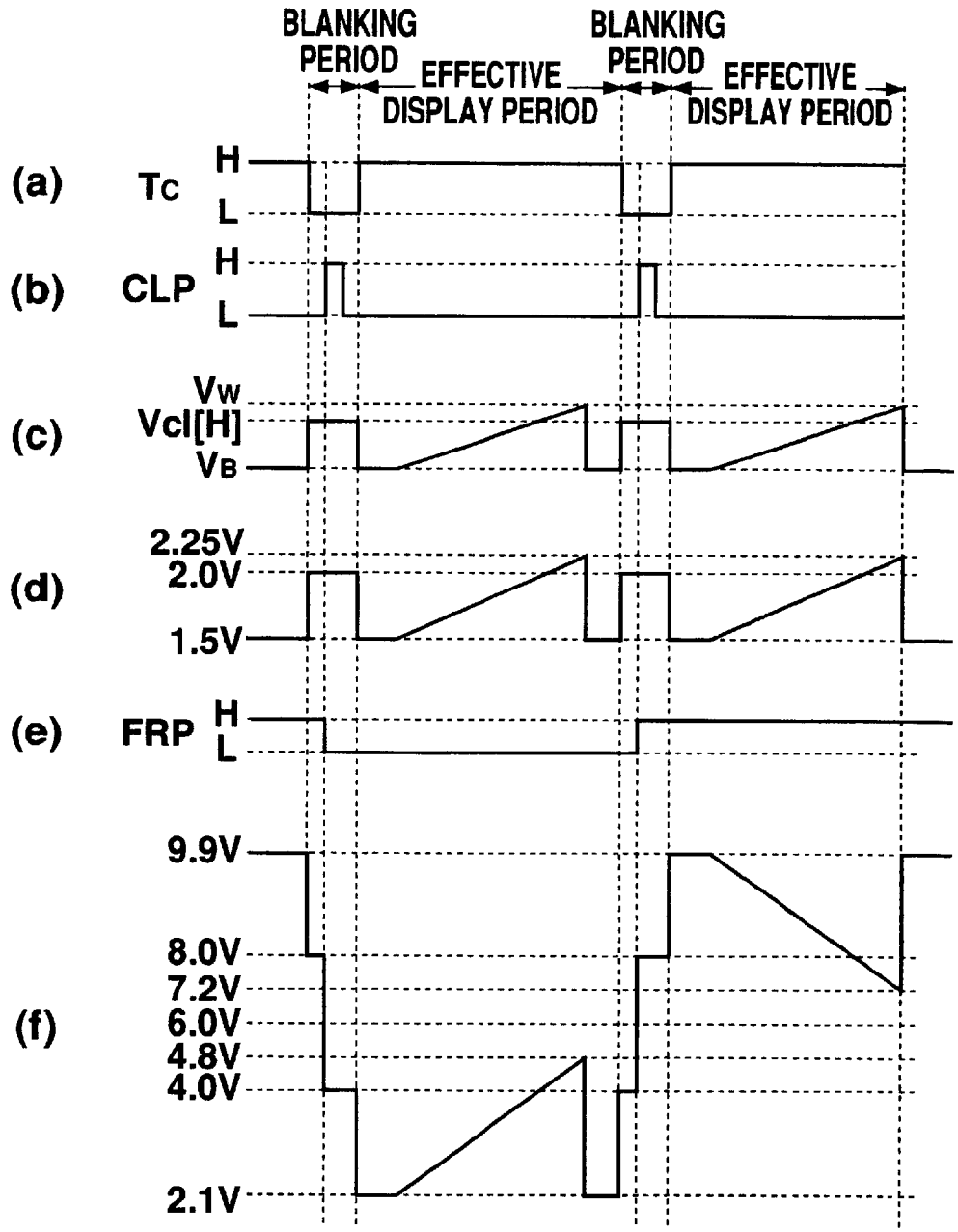

FIG. 6 and FIG. 7 show various signal waveforms relating to the present invention. FIG. 6(*a*) and FIG. 7(*a*) are for the timing control signal TC, FIG. 6(*b*) and FIG. 7(*b*) are for the clamping pulse CLP, FIG. 6(*c*) and FIG. 7(*c*) are for the analog RGB signal, which is the digital output from the reference voltage control circuit 100 converted into an analog signal, FIG. 6(*d*) and FIG. 7(*d*) are for the voltage signal at point A in FIG. 5, FIG. 6(*e*) and FIG. 7(*e*) are for the polarity inversion pulse FRP, and FIG. 6(*f*) and FIG. 7(*f*) are for the picture signal that is output from the RGB driver 3 and finally sent to the LCD 4. As will be described hereinafter, FIG. 6 and FIG. 7 have different reference voltage levels Vcl, which is a feature of the present invention.

The embodiment of the present invention will be described with reference to FIGS. 3 to 7. At the reference voltage control circuit 100, the digital image data that is controlled by the reference voltage in accordance with the brightness level is converted by the D/A converter 2 into an analog signal of amplitude 0.75 V as shown in the example in FIG. 6(*c*) or FIG. 7(*c*). At the clamping circuit within the RGB driver 3, this analog image signal is clamped to 2 V, for example, with the reference voltage level at the brightness reference level as shown in FIG. 6(*d*) or FIG. 7(*d*). This analog image signal is further inverted and amplified by the inverting amplifier 31 and amplified by the non-inverting amplifier 32 so that, for example, the 2 V becomes 8 V or 4 V while centering on 6 V. These inverted amplification signal and non-inverted amplification signal are switched in accordance with the polarity inversion pulse FRP shown in FIG. 6(*e*) and FIG. 7(*e*) to yield a picture signal having the switched polarity shown in FIG. 6(*f*) and FIG. 7(*f*). In FIGS. 6 and 7, the first half (left side of the figure) is the non-inverting period and the second half (right side of the figure) is the inverting period.

When FIG. 6(*c*) and FIG. 7(*c*) are compared, the relative voltages with respect to the signal amplitude of the reference voltage level Vcl are different. Namely, the reference voltage level Vcl[L] in FIG. 6(*c*) is low and the reference voltage level Vcl[H] in FIG. 7(*d*) is high. In the reference voltage circuit 100, the height is determined in accordance with the brightness level, and when the brightness level is high, the reference voltage level Vcl[L] is low, and when the brightness level is low, the reference voltage level Vcl[H] is high. These reference voltage levels Vcl[H] and [L] are regenerated by the clamping circuit 35 into a fixed DC value, such as 2 DC, for example, as shown in FIG. 6(*d*) and FIG. 7(*d*).

As a result, white level VW and black level VB in FIG. 6(*c*) and FIG. 7(*c*) are respectively 2.5 V and 1.75 V in FIG. 6(*d*) and respectively 2.25 V and 1.5 V in FIG. 7(*d*). Namely, since the reference voltage level Vcl is always regenerated into DC as a fixed absolute voltage value, varying the relative voltage of the reference voltage level Vcl in FIG. 6(*c*) and FIG. 7(*c*) enables the DC level of the analog image signal, which is clamped and regenerated into DC, to be controlled as shown in FIG. 6(*d*) and FIG. 7(*d*).

The signal with its DC voltage level controlled in this manner is amplified from the 2 V level to a 8 V or 4 V level, and is both inverted and not inverted at the inverting amplifier 31 and the non-inverting amplifier 32. As a result, if the reference voltage level Vcl is relatively low as shown in FIG. 6(*c*), the analog image signal is high with respect to the amplified reference voltage Vcl of 4 V, and the signal of FIG. 6(*d*) is amplified to a signal having a small amplitude with a trough of 2.5 V and a crest of 9.5 V as shown in FIG. 6(*f*). At the LCD 4, an AC inverting drive centering on 6 V is performed so that the applied voltage is generally low, namely, the brightness level is generally controlled to a high level in the normally white mode.

Conversely, as shown in FIG. 7(*c*), if the reference voltage level Vcl is relatively high, the analog image signal is low with respect to the 4 V after amplification, and the signal of FIG. 7(*d*) is amplified to a signal having a large amplitude with a trough of 2.1 V and a crest of 9.9 V as shown in FIG. 7(*f*). Therefore, the brightness level is controlled to a generally low level.

In this manner, by controlling the reference voltage level Vcl in the blanking period in accordance with the brightness level, the brightness control is performed without substantially increasing the circuit size.

Figure 8:
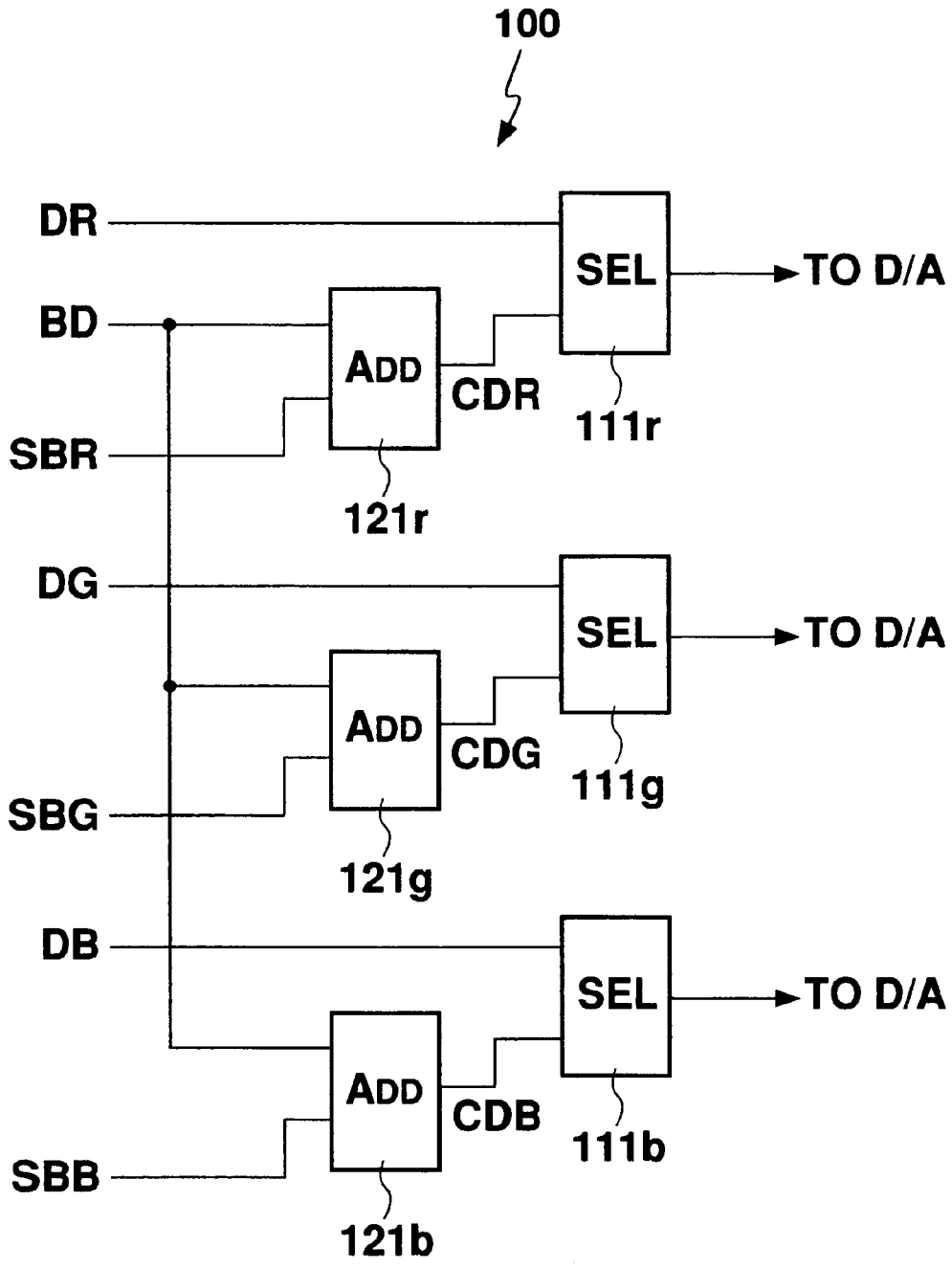
FIG. 8 shows an example configuration of the reference voltage control circuit of the LCD module relating to the embodiment of the present invention.

FIG. 8 shows the configuration of the reference voltage control circuit 100 relating to another aspect of the embodiment of the present invention. The reference voltage control circuit 100 is provided within the signal processor circuit 1 of FIG. 3, and the circuit 100 includes first to third selectors 111 (111*r*, 111*g*, 111*b*) and first to third adders 121 (121*r*, 121*g*, 121*b*) belonging to the RGB lines. Each adder 121 (121*r*, 121*g*, 121*b*) inputs and adds the brightness data BD and sub-brightness data SBR, SBG, and SBB. The brightness data BD is common among the RGB lines and the sub-brightness data SRB, SBG, and SBB are adjusted to the characteristics of each of the RGB lines. They may be controlled by software or set to predetermined values. The results of addition of the brightness data BD to each sub-brightness data SBR, SBG, and SBB are input by one of the selectors 111, 112, 113 as reference voltage data CDR, CDG, and CDB for control of both the brightness data and the sub-brightness data. The RGB image data DR, DG, and DB are supplied to the other inputs of the selectors 111, 112, 113, and one of the digital data DR, DG, and DB and reference voltage data CDR, CDG, and CDB are output. Described in more detail, during the effective display period of the digital data DR, DG, and DB, the digital data DR, DG, and DB are output, and during the blanking period, the reference voltage data CDR, CDG, CDB are output.

In the LCD module relating to this aspect, the RGB driver 3 has the same configuration as FIG. 5 described above so its description will be omitted.

Furthermore, the signal waveforms at each circuit are identical to those shown in FIGS. 6 and 7 described above.

In the present aspect, the reference voltage level of the blanking period in the aspect described above can be easily adjusted by using the digital brightness data, and furthermore, the reference voltage level for each of the RGB lines can be adjusted by the reference voltage generator circuit as shown in FIG. 8. More specifically, the brightness data BD and the desired sub-brightness data SB for every RGB line (SBR, SBG, SBB) are added to generate the reference voltage data CD (CDR, CDG, CDB). Furthermore, the reference voltage data CD generated for every RGB line is added to the corresponding digital data DR, DG, and DB. Therefore, analog data having optimum amplitude can be generated for every color and supplied to the LCD 4. A difference in the transmittance in the liquid crystal layer often differs among the RGB colors with respect to the same driving voltage. In such a case, it is necessary to generate and apply an optimum driving voltage for every RGB color to the LCD 4 in order to perform high quality display with high color reproducibility. The LCD module relating to this aspect allows the amplitude of the picture signal supplied to the LCD 4 to be adjusted for every color so that there is no increase in circuit size and so that each color can be adjusted to an optimum brightness level.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A drive circuit for a display apparatus comprising a plurality of display elements, the drive circuit comprising:

a reference voltage control circuit for generating a reference voltage level on the basis of a brightness control signal and inserting the reference voltage level into the blanking period of the input image signal;

a clamping circuit for shifting the input image signal to which reference voltage data is inserted into the blanking period by clamping the reference voltage level of the input image signal output to a predetermined voltage; and an amplifier circuit for amplifying a signal output from said clamping circuit, wherein a direct voltage level of the amplified signal output from said amplifier circuit is controlled by controlling said reference voltage, and the amplifier circuit determines the direct current voltage level of the output on the basis of the reference voltage level and amplifies the difference between a level of the input image signal during an effective display period and the reference voltage level.

2. The drive circuit according to claim 1 wherein:

said reference voltage control circuit outputs, instead of a digital input image signal during the blanking period of said digital input image signal, digital reference voltage data generated on the basis of a digital brightness control signal, and controls said reference voltage level.

3. The drive circuit according to claim 1 wherein said reference voltage control circuit comprises:

a reference voltage data generator circuit for generating the reference voltage data corresponding to the reference voltage level on the basis of said brightness control signal; and a switching circuit for switching, in accordance with a timing signal, said input image signal and said reference voltage data to be output.

4. The drive circuit according to claim 1 wherein:

said reference voltage control circuit controls said reference voltage level using a sub-brightness control signal together with said brightness control signal.

5. The drive circuit according to claim 4 wherein:

said sub-brightness control signal is set separately for each of red image signal, green image signal, and blue image signal for color display.

6. The drive circuit according to claim 4 wherein said reference voltage control circuit comprises:

the reference voltage data generator circuit for generating the reference voltage data corresponding to said reference voltage level on the basis of said brightness control signal and said sub-brightness control signal; and the switching circuit for switching, in accordance with the timing signal, said input image signal and said reference voltage data to be output.

7. The drive circuit according to claim 1, wherein the direct voltage level of the analog image signal output from the amplifier circuit is output at a low level when said reference voltage is set to be high with respect to said input image signal;

the direct voltage level of the analog image signal output from the amplifier circuit is output at a high level when said reference voltage is set to be low with respect to said input image signal; and the reference voltage is reduced as the brightness control signal becomes larger and is increased as the brightness control signal becomes smaller.

8. A drive circuit for a display apparatus comprising a plurality of display elements, the drive circuit comprising:

a reference voltage control circuit for outputting, instead of an input image signal during the blanking period of said input image signal, reference voltage level generated in accordance with a brightness control signal, and outputting, during an effective display period of said input image signal, the input image signal;

a clamping circuit for converting the reference voltage level in said blanking period for the signal output from said reference voltage control circuit into a predetermined brightness reference voltage level; and an amplifier circuit for amplifying a signal output from the clamping circuit, wherein a direct voltage level of the amplified signal output from said amplifier circuit is controlled by controlling said reference voltage level.

9. The drive circuit according to claim 8 wherein:

said reference voltage control circuit outputs, instead of a digital input image signal during the blanking period of said digital input image signal, the digital reference voltage data generated on the basis of the digital brightness control signal.

10. The drive circuit according to claim 8 wherein:

said reference voltage control circuit controls said reference voltage level in accordance with the sub-brightness control signal together with said brightness control signal.

11. The drive circuit according to claim 10 wherein:

said sub-brightness control signal is individually set for each of red image signal, green image signal, and blue image signal for color display.

12. The drive circuit according to claim 10 wherein:

said reference voltage control circuit outputs, instead of the digital input image signal during the blanking period of said digital input image signal, the digital reference voltage data generated on the basis of the digital brightness control signal and digital sub-brightness control signal.

13. The drive circuit according to claim 10 wherein said reference voltage control circuit comprises:

the reference voltage data generator circuit for generating the reference voltage data on the basis of said brightness control signal and said sub-brightness control signal; and the switching circuit for switching, in accordance with the timing signal, said input image signal and said reference voltage data to be output.

14. The drive circuit according to claim 8, wherein the direct voltage level of the analog image signal output from the amplifier circuit is output at a low level when said reference voltage is set to be high with respect to said input image signal;

the direct voltage level of the analog image signal output from the amplifier circuit is output at a high level when said reference voltage is set to be low with respect to said input image signal; and the reference voltage is reduced as the brightness control signal becomes larger and is increased as the brightness control signal becomes smaller.

* * * * *